United States Patent [19]

Langsam

[11] Patent Number: 4,846,043

[45] Date of Patent: Jul. 11, 1989

[54] BULLET TRAP AND A METHOD OF USING IT

[76] Inventor: Stuart Langsam, 25 Milrose La., Monsey, N.Y. 10952

[21] Appl. No.: 157,056

[22] Filed: Feb. 16, 1988

Related U.S. Application Data

[63] Continuation of Ser. No. 438,010, Nov. 14, 1983, abandoned.

[51] Int. Cl.[4] ..... F41G 11/00; F41J 1/14

[52] U.S. Cl. ..... 89/1.1; 89/36.02; 273/403; 273/410

[58] Field of Search ..... 273/404, 403, 410; 89/36.02, 1.1, 1.11

[56] References Cited

U.S. PATENT DOCUMENTS

| | | | |
|---|---|---|---|
| 941,642 | 11/1909 | Maxim | 273/410 |
| 4,198,454 | 4/1980 | Norton | 89/36.02 |
| 4,201,385 | 5/1980 | Szabados | 273/410 |
| 4,292,882 | 10/1987 | Clausen | 89/36.02 |
| 4,404,889 | 9/1983 | Miguel | 89/36.02 |

FOREIGN PATENT DOCUMENTS

| | | | |
|---|---|---|---|
| 2417743 | 2/1978 | France | 273/403 |

OTHER PUBLICATIONS

"United States Infantry Guide", *Small Arms Firing Manuel,* pp. 801–803, J. B. Lippincott Co., (1918).

*Primary Examiner*—David H. Brown
*Attorney, Agent, or Firm*—Felfe & Lynch

[57] ABSTRACT

A bullet trap comprises a lid over a container body holding aggregated, randomly- or not-randomly-arranged swatches of one or more types of polyacrylamide fiber material or the like. The lid is penetrable by bullets and the aggregated swatches slow any bullets which penetrate the lid sufficiently to retain them in the container. The bullet trap is intended for use in a method of safely loading and unloading firearms in which the firearm is aimed at the trap during loading and unloading to trap any bullets accidentally discharged during loading and unloading.

1 Claim, 1 Drawing Sheet

BULLET TRAP AND A METHOD OF USING IT

This is a continuation application of application Ser. No. 458,010, filed Jan. 14, 1983, now abandoned.

BACKGROUND OF THE INVENTION

The invention relates to a bullet trap and, more particularly, a trap for retaining bullets in a container with randomly-aggregated swatches of polyacrylamide or like fiber material, and relates to a method of using the bullet trap as a safety device during the loading and unloading of firearms.

One tradition of the American West, the revolver, has long influenced the pistol firearms most used by the American military, police, and sportsman. Revolvers are loaded by swinging the revolving bullet chamber out of alignment with the barrel and firing mechanism of the pistol. They thus present relatively little danger of accidentally discharging one of the bullets during. It is still possible for a revolver to discharge accidentally during, however, particularly if the revolver is carelessly handled as the revolving chamber is swung back to the firing position.

In Europe, and now increasingly in the United States, automatically-loading pistols or autoloaders are often used by the military, police, and sportsman. One of the advantages of these firearms is the ability to replace the bullet in the firing chamber quickly and thus achieve rapid, automatic or semi-automatic firing of up to sixteen successive bullets at one loading. For a number of reasons, including cost and achieving more rapid initial enablement of the weapon and more rapid repeat firing, the safety mechanisms for preventing discharge of such weapons are becoming increasingly delicate and liable to malfunction in such a way as to allow the weapons to discharge accidentally during loading and unloading. This susceptibility of magazine fed autoloading pistols, combined with their increasingly wide-spread use, particulatly in America, has increased the danger of injury from accidental discharge during loading and unloading.

One conspicuous example of this danger arises in the locker rooms of police agencies which provide their officers with auto-loading pistols. A number of police officers preparing for work on the same shift often congregate in thses rooms and load their pistols there in preparation for duty. Even with careful handling of their pistols, the accidental discharge of any of officer's gun during loading and unloading dangerously ricochets a bullet around the room ane exposes all of those present to unnecessary risk of injury.

The same interests in rapid-firing, light-weight, high capacity magazine fed firearms have also promoted the development and use of automatically-loading, repeat-firing rifles, submachine guns, machine pistols and shot guns for the military, police and sportsman. These firearms are subject to the same risk of accidental discharge as automatically-loading pistols. Because of their higher power, however, they present even more danger.

The rapid-firing rifles developed for the military and law enforcement agencies also fire successive bullets at very short intervals. An accidental discharge from such firearms therefore presents the danger, not of a single bullet, but of a burst of many bullets. Even with the best of safety mechanisms, therefore, the danger from an accidental discharge of such firearms is extreme.

The danger from an accidental discharge of an autoloading recreational firearm is also greater, not only because of its greater fire power, but also because sportsmen, regretably, often do not have the training in loading and unloading, safety procedures, and respect for their firearms instilled in the military and police. Recently, for example, a sportsman is said to have had the misfortune to have been loading and unloading a powerful firearm carefully aimed at the floor, but to have nevertheless injured his own child in the room below when the firearm accidentally discharged during loading and unloading.

For all of these reasons, and for all of the military, law enforcement and recreational uses of firearms, there therefore is a need for a bullet trap at which the firearm could be directed during loading and unloading for safely trapping any bullets accidentally discharged during the loading and unloading operation. As used herein, bullets are intended to include any type of projectile discharged from a firearm, whether BB from an air gun, bullet, or shot from a shotgun.

Bullet traps are known for other uses. One well-known uses is in ballistics testing. For such use, however, it is of course necessary to preserve the ballistic markings on the bullet for analysis. The bullet traps designed for this purpose therefore provide for gently stopping the bullet without damage to the bullet. Gently decelerating the bullet, in turn, has required large water- or fiber-pile-filled bullet traps. They are too big and heavy for location in the field, the locker room, the home, and the many other places where firearms may be loaded. Such bullet traps are therefore unsuitable for a safety device at which a firearm may be aimed during loading and unloading.

SUMMARY OF THE INVENTION

It is therefore an object of the invention to provide a bullet trap and a method of using it as a safety device during the loading and unloading of firearms.

To these ends, the invention provides an open-sided container body. Inside the container body is an arrangement for aggregating sufficient swatches of one or more types of polyacrylamide fiber material or the like sufficiently for slowing any bullet discharged from the firearm during loading and unloading sufficiently for retention in the container.

The aggregated swatches of polyacrylamide or like fiber material have a remarkable bullet-slowing property in spite of the interstices and lack of structural integrity among the swatches even when randomly arranged, as is preferred. The swatches have no particular shape. The fiber material of the swatches may be a woven or non-woven type of one or more layers. The swatches can be suitably aggregated by the inside surfaces of the container, but the preferred embodiments later described aggregate the swatches in a ticking to form one or more pillows in the container for easier assembly and replacement if damaged by bullets caught in the trap. Materials like polyacrylamide fiber material include any made from a high tensile strength fiber suitable for the bullet trap function. Polyacrylamide fibers are preferred because they are commercially available under the trademark Kevlar and because they are among the strongest fibers known.

The remarkable bullet-slowing properties of the aggregated, preferably randomly-arranged swatches of polyacrylamide or like fiber material are suggested by tests of embodiments of the bullet trap in which an entire magazine of bullets from a firearm at close range were stopped in pillow aggregated of swatches about ten inches (25 cm) thick. As a result, an embodiment of the bullet trap can be made in a cube about 11 inches (28 cm) on a side or a cylinder of like size. This remarkably small bullet trap can be conveniently used on a wall, on the floor, on a shelf, inside a locker, in a desk drawer, in the home, aboard a warship, in the field, and just about any other place a firearm can be loaded or unloaded.

The bullet trap therefore has particular utility in a method of safely loading and unloading a firearm in which the firearm is merely aimed at the trap in such a way that the trajectory of any bullet discharged from the firearm during loading and unloading projects to the trap. With most firearms, this merely involves aiming the barrel of the firearm at the trap during the loading and unloading operation. In combination with the convenient size of the bullet trap described above, the method thus provides a safe way of loading and unloading a firearm which may be used conveniently in just about any location in which the firearm can be loaded or unloaded.

DESCRIPTION OF THE DRAWINGS

Preferred embodiments which are intended to illustrate but not to limit the invention will be described with reference to drawings in which.

DESCRIPTION OF THE PREFERRED EMBODIMENTS

Figure 1:
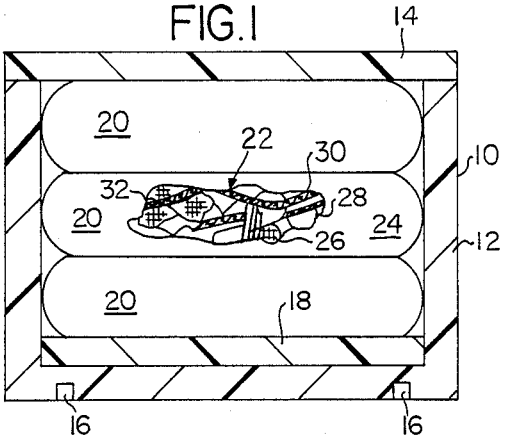
FIG. 1 is an elevation, partly in section and partly cut away, of a first preferred embodiment of the invention.

The first preferred embodiment of the bullet trap of the invention, shown in FIG. 1, has an upright container 10 with a body portion 12 and a horizontal lid 14 over the vertical body portion of the container. The horizontal lid 14 is substantially equal in size to the largest cross-section of the container 10 as shown in FIGS. 1–5. The body portion 12 of the container may be made from any material without particular regard to the bullet-slowing characteristics of the material. The lid 14 is made from a material which is penetrable by the bullet discharged during loading or unloading from the firearm with which the trap is intended to be used.

The body portion 12 of the container has, optionally, mounting receptacles 16 on the outside of the container body opposite the lid so that the bullet trap can be mounted on a wall if desired. The entire container is a cube about 11 inches (28 cm) on a side. Wall mounting is thus only one of the many possible locations in which the trap can be used.

Inside the container body 12 on the side opposite the lid 14 is a plate 18 made of a material which is resistant to bullet penetration. Three pillows 20 each filled with an aggregation of randomly-arranged swatches of one or more types of polyacrylamide or like fiber material are piled on top of the plate 18 and substantially fill the container. Experimental tests of this structure suggest that the pillows 20 will stop even the repeated penetration of the pillows by several bullets on the same or adjacent trajectories. The bullet resistant plate 18 is therefore intended to provide the bullet trap with an absolute margin of safety in support of the intended use of the bullet trap as a safety device in the loading or unloading of firearms.

The ticking 24 about one of the pillows 20 is cut away to show the swatches generally designated 22 filling the pillows. The swatches have various shapes. Some, like swatches 26, are a woven fiber material. Others, like swatches 28, are non-woven fiber material. Some, like swatches 30, are single layer material. Others, like swatches 32, are multiple layer material. All of these types of material may be used in the bullet trap. Each is formed from polyacrylamide fibers or other like fibers having a high tensile strength. The ticking on each pillow aggregates the swatches sufficiently to slow any bullet which penetrates the lid 14 sufficiently that the bullet is retained within the container, with the assistance, if necessary, of the bullet-resistant plate 18.

Figure 2:
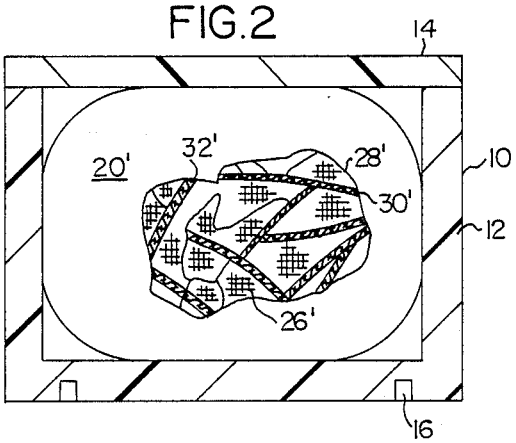
FIG. 2 is a elevation, partly in section and partly cut away, of a second preferred embodiment of the invention.

FIG. 2 shows another preferred embodiment of the bullet trap which differs from that shown in FIG. 1 in having but a single pillow 20' and omitting the plate 18. This embodiment therefore does not provide the advantage of the embodiment shown in FIG. 1 of being able to change only the lid and such of the pillows 20 as have been damaged by the accidental discharge of a bullet into the trap when the trap is used as a safety device during the loading and unloading of a firearm. With the bullet-resistant plate omitted, it may also be desirable to form the container body 12 of bullet-resistant material to provide a safety margin to the bullet-slowing pillow.

Figure 3:
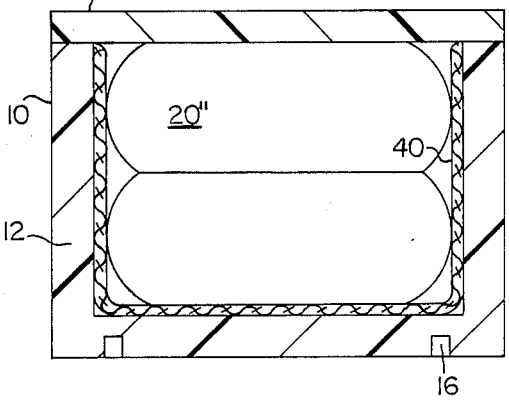
FIG. 3 is an elevation, partly in section, of a third preferred embodiment of the invention.

The embodiment shown in FIG. 3 differs from that shown in FIGS. 1 and 2 only in having two pillows 20'' and a boot 40 lining all the walls of the body portion 12 of the container. The boot 40 is made from a flexible bulletresistant material such as a woven polyacrylamide fiber material similar to that used in bullet proof vests backed on the container side by sufficient compressible material to provide bullet-stopping flexure to the fiber material. The boot thus serves the same margin-of-safety function as the plate 18 (FIG. 1) for keeping in the container any bullets which may penetrate the lid and one or more of the pillows 20'.

The embodiments shown in FIGS. 1, 2, and 3 are intended to be used with firearms aimed at the lid of the container from a range at which the pillows 20, 20', and 20'' plate 18, and boot 40 are designed to retain the bullet within the container. This range depends, of course, on the caliber and other firing characteristics of the firearm and the relative bullet-slowing characteristics of the lid, pillows and container. The range from which the firearm is discharged, however, also avoids the hazard of plugging the barrel or other discharge passage of the bullet from the firearm. Aiming the firearm at the bullet trap without plugging the barrel of the firearm becomes more difficult with long barrelled firearms such as rifles, and shotguns.

Figure 4:
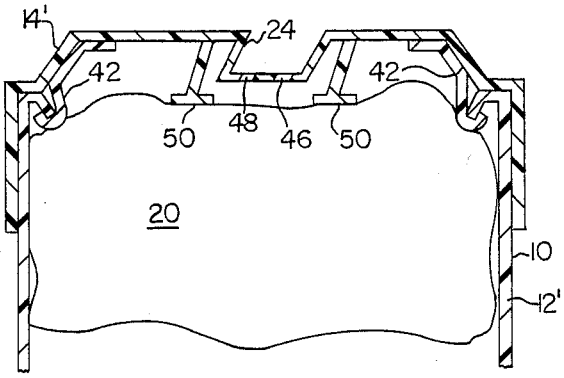
FIG. 4 is an elevation, partly in section and partly cut away, of a fourth preferred embodiment of the invention.

The embodiment shown in FIG. 4 is particularly intended for use with such long barrelled firearms. It differs from the embodiments shown in the other Figures in the structure of the body portion 12' of the container 10 and the lid 14' over the body portion. The lid 14' has peripheral lugs 42 which engage cooperative lugs on the body portion 12' of the container to hold the lid on the container. A receptacle 44 is formed in the lid for receiving the barrel of the firearm to be used with the bullet trap. This makes it easier to aim the firearm, and especially long-barrelled firearms, at the trap.

The receptacle has an opening 46 into the container to avoid plugging the barrel when it is inserted into the receptacle. An additional opening 48 is provided to receive a sight on the end of the barrel.

Footed lugs 50 project farther than the receptacle 44 from the lid around the receptacle to depress the surface of the pillow 20 in the container from the receptacle 44. This assures that the inside of the opening 46 for the barrel of the firearm is not plugged by the pillow. In combination, therefore, the barrel of a firearm may be butted point blank against the floor of the receptacle 44 to assure the aim of the firearm into the bullet trap without danger of the receptacle 44 or underlying, bullet-slowing pillow 20 plugging the barrel of the firearm.

Figure 5:
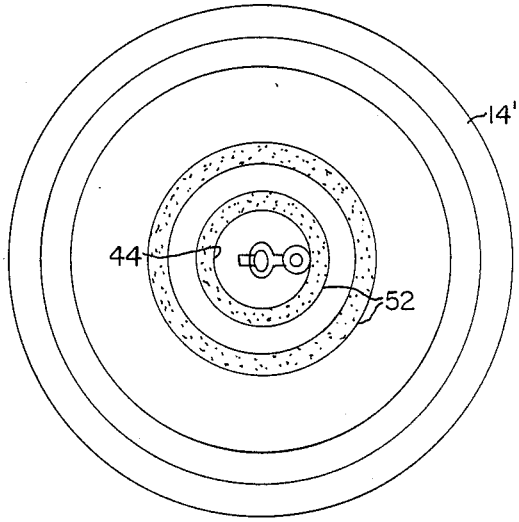
FIG. 5 is a plan view of the embodiment shown in FIG. 4.

FIG. 5 shows a plan view of the lid 14' shown in FIG. 4. It has a concentric target rings 52 emblazoned on the outside surface of the lid 14. If the barrel of a firearm is not inserted into the receptacle 44 as described with reference to FIG. 4, either the receptacle 44 or the target rings 52 provide an easily recognizable target at which to aim the firearm. The target rings 52 are therefore useful also with the embodiments of the bullet trap shown in FIGS. 1, 2, and 3.

The receptacle 44 is inclined from the vertical. This allows the bullet trap to be placed on a floor and a long firearm barrel to be inclined into the trap conveniently from a standing position.

The small size and convenient construction of the several embodiments of the bullet trap above described make the bullet trap particularly useful in a method of safely loading and unloading a firearm. In the method, the firearm is merely aimed at the trap, preferably with the aid of a target ring 52 or a receptacle 44, in such a way that the trajectory of any bullet accidentally discharged from the firearm when loading or unloading it projects to the trap and from a range and direction at which the trap is capable of trapping the bullet. Aiming the firearm at the trap for retaining a bullet therein clearly contemplates some degree of aiming related to the trap structure; aiming through a corner of the trap, or the like, may not be sufficient and if not, is not included in the described method. Any accidentally discharged bullets will then penetrate the lid, but be retained in the body of the trap container to avoid risk of harm. The small size of the bullet trap makes it portable to almost any location in which a firearm may be loaded and unloaded, such convenience of use, even in a vehicle or aircraft, being particularly desirable to encourage the use of the bullet trap as the loading and unloading safety device.

The bullet trap may be made in still other embodiments having other shapes and other features as may occur to those in the art. For example, the bullet trap may be provided with a carrying handle to facilitate use in different locations where a firearm may be loaded or unloaded. A wire hoop handle as used commonly on buckets would be suitable for this. Entirely different bullet traps may also be used in the method of the invention. These and still further variations of the invention as may occur to others are intended to be within the scope of the following claims.

What is claimed is:

1. Method for safely trapping a bullet accidentally discharged from a firearm pointed generally downward during loading or unloading of such firearm in a confined area such as a police locker room or like area which comprises:

(a) providing in such confined area bullet trap means capable of trapping any bullets accidentally discharged from the firearm during loading or unloading thereof in such confined area, said trap means having a substantially horizontal lid member substantially equal in size to the largest cross-section of the trap means, all of said lid member being readily penetrable by an accidentally discharged bullet;

(b) pointing the firearm generally downwards at said horizontal lid member in such confined area;

(c) loading or unloading the firearm in such confined area while pointing same generally downwards at said horizontal lid member; and (d) safely trapping any bullet accidentally discharged the firearm during loading or unloading in such confined area while pointing the firearm generally downwards at said horizontal lid member, any such accidentally discharged bullet penetrating said lid member and being safely trapped in said bullet trap means.

* * * * *